United States Patent [19]

Koike

[11] Patent Number: 4,724,686

[45] Date of Patent: Feb. 16, 1988

[54] HAND KNITTING MACHINE

[75] Inventor: Fuji Koike, Nagoya, Japan

[73] Assignee: Loyal Kogyo Kabushiki Kaisha, Nagaoya, Japan

[21] Appl. No.: 56,015

[22] Filed: Jun. 1, 1987

[30] Foreign Application Priority Data

| | | | |
|---|---|---|---|
| May 31, 1986 | [JP] | Japan | 61-126688 |
| Sep. 17, 1986 | [JP] | Japan | 61-219932 |
| Oct. 1, 1986 | [JP] | Japan | 61-233497 |

[51] Int. Cl.[4] ..... D04B 7/00

[52] U.S. Cl. ..... 66/75.2

[58] Field of Search ..... 66/75.2, 76, 70, 207

[56] References Cited

U.S. PATENT DOCUMENTS

| | | | |
|---|---|---|---|
| 3,760,610 | 9/1973 | Hadam et al. | 66/75.2 |
| 4,167,861 | 9/1979 | Krause et al. | 66/75.2 |
| 4,510,774 | 4/1985 | Rose | 66/75.2 |
| 4,608,642 | 8/1986 | Shima | 66/75.2 |
| 4,614,095 | 9/1986 | Porat | 66/207 |

*Primary Examiner*—Ronald Feldbaum

*Attorney, Agent, or Firm*—Sughrue, Mion, Zinn, Macpeak, and Seas

[57] ABSTRACT

A hand knitting machine comprising a transversely extended needle bed having grooves, each receiving a hooked latch needle and a carriage having cam grooves formed on the undersurface thereof so that every transverse movement of said carriage may form a row of stitches by engagement of the cam grooves with the needles to be reciprocated along the respective needle grooves, and means for detecting the relative movement between said carriage and said bed to generate a signal for controlling a computer so as to lower the design picture of the selected fabric to be knitted by one step, whereby the number of stitches to be formed in the next operation may be observed on the display unit.

7 Claims, 7 Drawing Figures

HAND KNITTING MACHINE

BACKGROUND OF THE INVENTION

The invention relates to a hand knitting machine comprising a transversely extended needle bed having a plurality of parallel grooves, each receiving a hooked latch needle and a carriage having cam grooves formed on the undersurface thereof and adapted to be reciprocatingly movable along said needle bed so that the needles may be engaged with the cam grooves to be reciprocatingly move in the respective grooves for forming stitches. More particularly this invention relates to a knitting machine further comprising means for detecting the relative movement between said cam carriage and said needle bed to generate a signal for controlling a computer so as to vertically lower or raise the design picture of the selected fabric to be knitted by one step, whereby the number of stitches to be formed in the next knitting operation and the positions of the stitches to be formed with different color of woolen yarn may be decided by the design picture on a display panel.

There are various hand knitting machines of various structures and arrangements, but it is common to all of them that they have at least one needle bed and the cam carriage to be relatively movable therealong so as to form one row of stitches.

Meanwhile, recently the low price of a computer to be loaded with an external memory such as a floppy disk is available for enjoying the so-called TV games by manually actuating keys on the control panel to move various elements appearing on the display unit attached with said computer or of the television set already equipped. Thus, it is possible to provide a softwear storing pictures of various knit fabrics such as sweater, gloves and the like of various designs, sizes patterns and so on to be reproduced on the display unit such as a cathode ray tube to be selected by the user of said knitting machine so as to reproduce the picture of the selected design on the CRT to which a picture of the scale showing the number of stitches in every row of stitches is to be composed and operate the computer to lower or raise said design picture below or above said scale every time one row of stitches is formed by one transverse travel of the cam carriage. It is not particularly difficult to provide such softwear or a floppy disk storing such information and operate the computer as referred to above which may make the operation of the hand knitting machine to be very easy for obtaining the desired knit fabric.

However, it is still difficult to actuate the concerned key of the computer control panel for lowering or raising the design picture step by step every movement of the cam carriage and count the number of stitches to be made on the next knitting operation.

It is, thus, an object of the invention to provide a hand knitting machine having means for detecting the relative movement of the needle bed and the cam carriage to eliminate necessity of actuation for controlling the computer to lower or raise the design picture on the display unit.

Other objects and advantages of the invention will be appreciated from the explanation on the preferred embodiments to be made in reference to the accompanying drawings.

DESCRIPTION OF THE PREFERRED EMBODIMENTS

Figure 1:
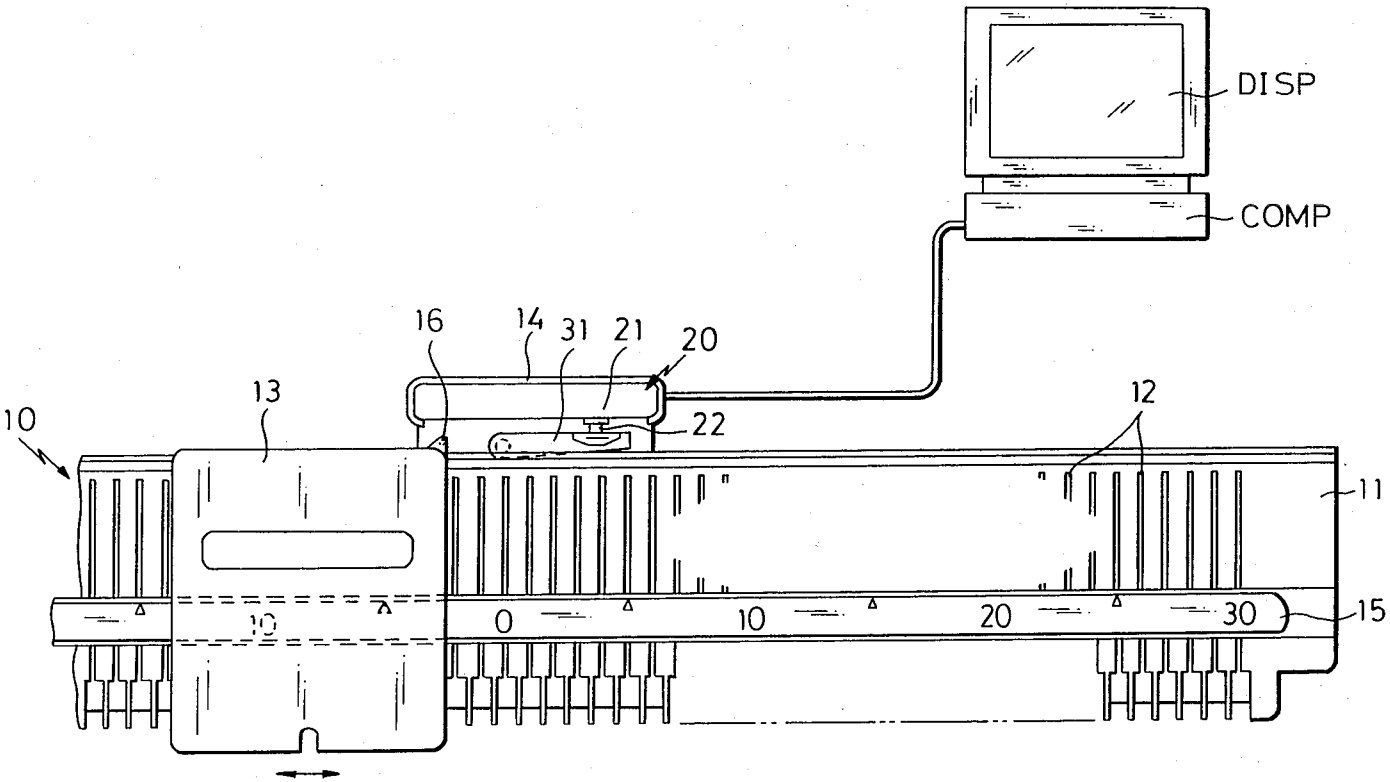
FIG. 1 is a top plan view of a part of the hand knitting machine comprising a needle bed and a cam carriage movable transversely therealong which is provided with mechanical computer control means according to one embodiment of the invention which is electrically coupled with a computer and a display unit respectively shown by a front elevation in a smaller scale.
Figure 2:
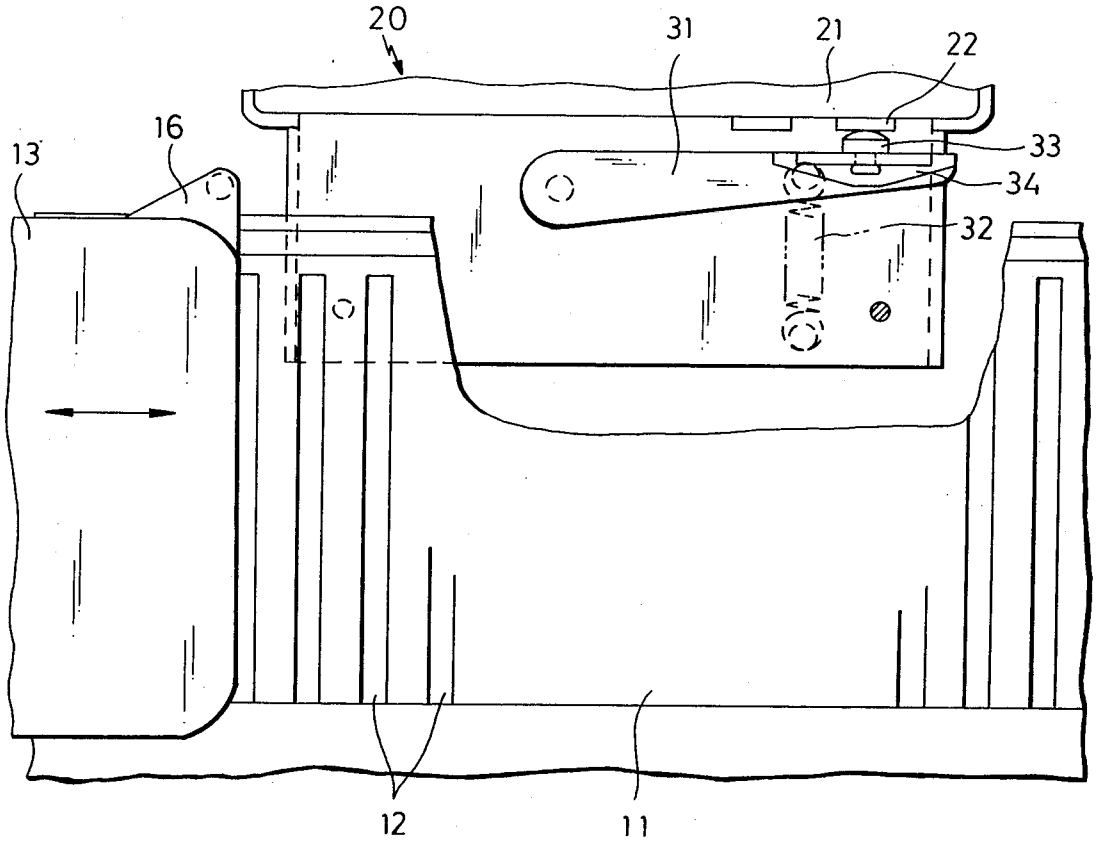
FIG. 2 is a top plan view only of parts of the cam carriage, the needle bed and the control means in a larger scale.

In FIGS. 1 and 2, a hand knitting machine represented generally by 10 comprises a transversely extended needle bed 11 formed with a plurality of parallel grooves 12 extending longitudinally thereof, each receiving a hooked latch needle for reciprocatingly movable therealong by engagement with cam grooves formed on the under surface of a carriage 13 which is adapted to be manually reciprocated laterally of the needle bed from left to right and vice versa.

There are various modifications in such hand knitting machine but it is common to all of them that one course of said lateral travel of the cam carriage from left to right or from right to left forms a row of stitches. The present invention is related to the above type of machine and the explanation to be made hereafter so that there will be no need for further explanation in more detail as to the construction and arrangements of the parts of the knitting machine.

It is preferable to provide a frame 14 mounted on the needle bed 11 at the opposite side wall thereof to disengageably receive therein computer control means represented generally by 20 in the form of a control panel 21 which is provided with at least one key 22 adapted to be pushed for the purpose to be explained in detail later every when the cam carriage 13 is transversely travelled along the needle bed 11 to pass the central point, point "zero" given on a transversely extended scale 15 on the bed as seen in FIG. 1.

For that purpose, the cam carriage 13 has a protruded pin 16. There is mounted a pivoted lever 31 on the wall of the frame 14, which is normally kept by a coiled spring 32 in the shown position where the key 22 is not actuated. The lever 31 has a push pin 33 and a cam 34 at the free end thereof so that when the carriage 13 is brought in the center point the protruded pin 16 engages with said cam 34 so as to angularly move the pivoted lever 31 against the force of said coiled spring 32, whereby key 22 is pushed by push pin 33 to be actuated.

The control panel 21 is electrically connected with a computer COMP which may be loaded with an external memory such as a floppy disk (not shown), which is electrically coupled with a display unit DISP such as a cathode ray tube display on which a design of a piece of fabric to be knitted, which is stored in memory, is outputted as shown i FIGS. 4–7.

Figure 4:
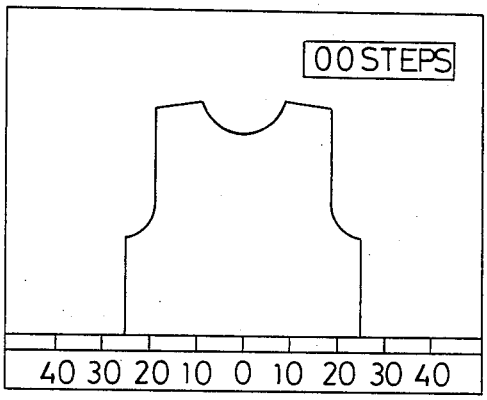
FIGS. 4, 5, 6 and 7 are respectively illustrations appearing on the display unit showing a design of a piece of fabric to be knitted and moved downward step by step by the computer which is controlled by said means every when the cam carriage is transversely moved.

FIG. 4 illustrates the design of the fabric to be knitted, say a sweater body portion. The designation "OOSTEPS" appearing above right means no step of knitting operation has yet been taken. The scale given under the fabric design is for showing number of stitches in every row corresponding to the scale 15 given on the needle bed 11.

In advance to the appearance of the fabric picture, the user of the hand knitting machine of course has pushed other concerned key or the control panel 21 preferably in reply to questions successively appearing on the display DISP regarding the sort of the fabric to be knitted such as sweater, gloves, socks and the like for man or women, size of the selected fabric such as S, M, L and LL and so on. Depending on the information stored in the external memory, various colored patterns on the fabric may be observed on the display picture to be selected.

The scale on the picture may be fixed to every design stored in the memory or only one stored therein to be composite to any design selected to appear on the display in which said scale is adapted to be reduced or enlarged corresponding to the selected size. The scale in FIG. 4 shows that the cam carriage 13 should be transversely moved to actuate 25+25=50 needles in the first row.

Figure 5:
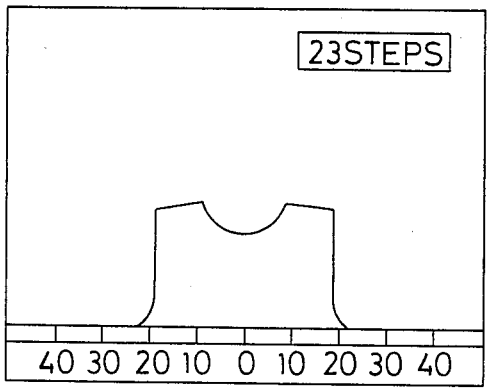
Figure 6:
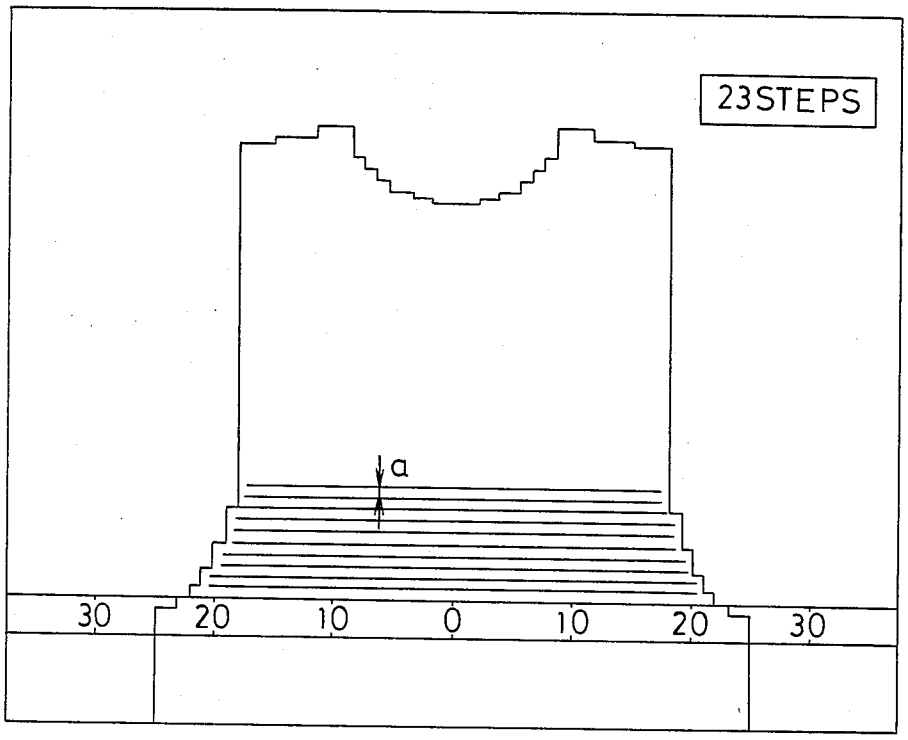

When the carriage is moved by the corresponding distance for example 22 times without changing of the stitch number and consequently of the number of the needles to be actuated by the cam carriage, the design picture is lowered step by step so as to be shown in FIG. 5 and in FIG. 6 in a larger scale, from which it is shown that the stitch number must be decreased from said 50 to 22+22=44 in the next 23rd operation. In FIG. 6 "a" means one step of the knit fabric design to be lowered every time one travel of the carriage is over. When the knitting operation is over and consequently the fabric design disappears out of the display picture, then for instance a design of the sleeve portion appears thereon so that the similar operation may be carried out without necessity of manual actuation of the key for the user.

Figure 7:
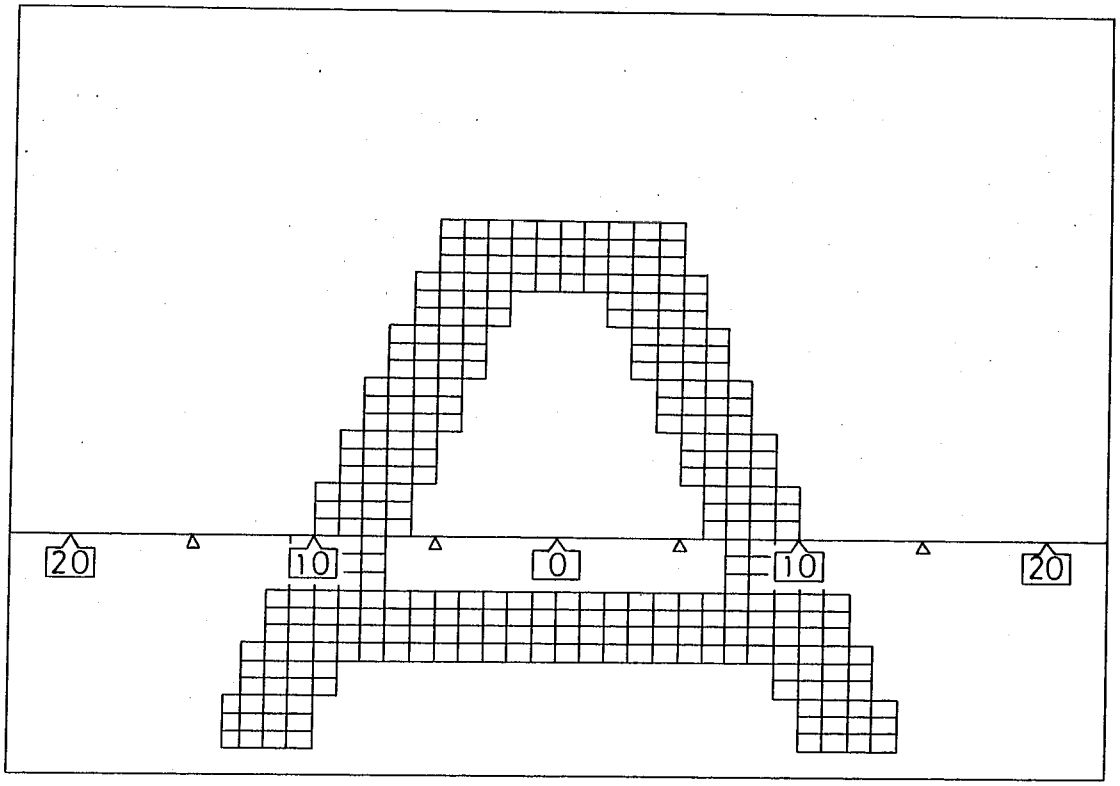

FIG. 7 shows a design of the pattern to be knitted with a different color of woolen yarn, for instance red yarn, while the other portion as shown in FIGS. 4–6 which is omitted in said FIG. 7 for the sake of clearness of the drawing is knitted with e.g. white yarn. Every small rectangle represents one stitch to be formed with said different color yarn so that the needles of the 6th to the 10th from the center point in the left and right sides should be actuated with being supplied of said different color yarn, e.g. red woolen yarn in the coming operation.

In case of particular actuation where two times of travel of the cam carriage are necessary for forming one row of stitches, it is naturally necessary to adjust the control panel so as to lower the design picture not by two steps but by only one step despite that the carriage pushes the key two times.

In the embodiment the control panel 20 is mounted on the side of the needle bed 11, but it goes without saying that said panel 20 can be mounted on the side of the cam carriage 13. The invention lies in actuating the key for moving the design picture by one step through the computer while utilizing the relative movement between the cam carriage and the needle bed. It is also possible not to lower the picture as explained in the above but to raise it step by step or even move it laterally relative to vertically televised scale.

Since the invention lies in utilizing the movement of the carriage relative to the needle for relatedly moving the televized picture, means for detecting said relative movement is not always restricted to the mechanical means as referred to above.

Figure 3:
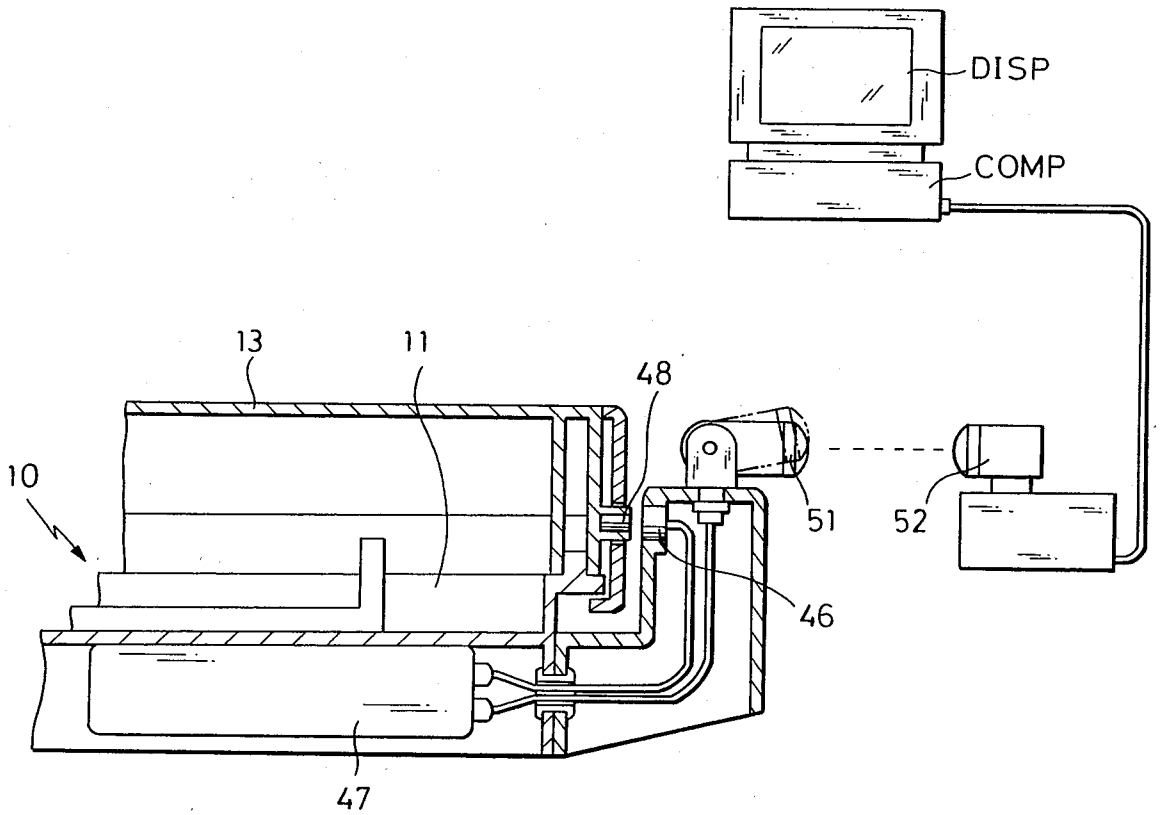
FIG. 3 is a sectional view of a part of the hand knitting machine provided with a pair of wireless signal sender and receiver according to the other embodiment of the invention, the latter of which is electrically coupled with the computer and the display unit respectively shown by a front elevation in a smaller scale.

FIG. 3 explains the second embodiment of the invention, in which there is provided sensor means for detecting the relative movement between the cam carriage and the needle bed to generate a signal which is sent to the computer for moving the design picture on the display unit. The signal can be sent to the computer through conductive wire or wirelessly.

In FIG. 3, there is provided a trigger 46 as sensor to actuate an oscillator 47 on the needle bed 11, while the carriage 13 is provided with an element such as a permanent magnet 48 for energizing said trigger so that every when the carriage 13 passes the sensor 47 said oscillator 47 generates the signal which is sent as some electromagnetic waves such as ultrashort wave, infrared ray from a directive sender 51 to a directive receiver 52 to control the computer COMP to move the design picture appearing on the display unit DISP as explained above in respect of the first embodiment. Of course instead of the directive sender and receiver, antennae may be used depending on nature of the electromagnetic waves to be transferred.

The invention may be utilized in the so-called CATV system so as to use not the external memory owned by the knitting machine user but the design pictures offered by the TV station.

What is claimed is:

1. A hand knitting machine comprising a transversely extended needle bed formed with a plurality of parallel grooves, each extending longitudinally thereof and receiving a hooked latch needle; a cam carriage having cam grooves formed on the undersurface thereof and adapted to be movable along said needle bed so as to engage with said needles to reciprocatingly move for forming stitches; and means for detecting the relative movement between said needle bed and said cam carriage so as to operate a computer to move a picture of the selected design of the fabric to be knitted appearing on a display unit step by stey every time the cam carriage is transversely moved, whereby conditions for the next knitting operation may be decided in reference to the design picture remaining on the display unit.

2. The hand knitting machine as set forth in claim 1, in which said detecting means comprises a pivoted cam lever urged in position by spring means and a computer control panel having at least one key for operating the computer so as to move the design picture by one step corresponding to one row of stitches so that every when the cam carriage is moved relative to the needle bed said pivoted cam lever is angularly moved against the force of said spring means to actuate said key.

3. The hand knitting machine as set forth in claim 2, in which said cam lever and said control panel are mounted on the needle bed so that every when said cam carriage is moved said arm is angularly moved against the force of said spring to push said key.

4. The hand knitting machine as set forth in claim 1, in which there is provided sensor means for detecting the relative movement between the needle bed and the cam carriage so as to generate a signal to be inputted in the computer for moving the design picture by one step on the display unit.

5. The hand knitting machine as set forth in claim 4, in which said signal is sent through conductive wires.

6. The hand knitting machine as set forth in claim 4, in which said signal is sent wirelessly from an electromagnetic wire sender provided on the needle carriage to an electromagnetic wave receiver provided on the computer.

7. The hand knitting machine as set forth in claim 1, in which there is provided a transversely extending scale on the needle bed for showing the respective needle position which corresponding to the corresponding scale appearing on the display unit and said design picture is moved vertically in reply to said relative movement so that the number of stitches to be formed in the next knitting operation is designated along said scale on the display unit so that the cam carriage may be moved in reference to the corresponding scale on the needle bed.

* * * * *